US011976821B2

(12) United States Patent
Hodges et al.

(10) Patent No.: US 11,976,821 B2
(45) Date of Patent: May 7, 2024

(54) CONTROL SYSTEM FOR A FUEL BURNING APPLIANCE AND A METHOD OF OPERATING SUCH AN APPLIANCE

(71) Applicant: Wolf Steel Ltd., Barrie (CA)

(72) Inventors: Paul Hodges, Richmond Hill (CA); Derek Fong, Barrie (CA); Wonmyung Seo, Barrie (CA)

(73) Assignee: Wolf Steel Ltd., Barrie (CA)

( * ) Notice: Subject to any disclaimer, the term of this patent is extended or adjusted under 35 U.S.C. 154(b) by 477 days.

(21) Appl. No.: 17/193,301

(22) Filed: Mar. 5, 2021

(65) Prior Publication Data

US 2021/0278087 A1 Sep. 9, 2021

Related U.S. Application Data

(60) Provisional application No. 62/986,233, filed on Mar. 6, 2020.

(51) Int. Cl.

| | |
|---|---|
| ***F24B 1/188*** | (2006.01) |
| ***F23N 3/00*** | (2006.01) |
| ***F23N 5/24*** | (2006.01) |
| ***F24B 1/02*** | (2006.01) |
| ***F24B 1/187*** | (2006.01) |
| ***F24B 1/19*** | (2006.01) |
| ***F24B 7/04*** | (2006.01) |

(52) U.S. Cl.

CPC ..... *F24B 1/1888* (2013.01); *F23N 3/002* (2013.01); *F23N 3/005* (2013.01); *F23N 5/242* (2013.01); *F23N 5/245* (2013.01); *F24B 1/028* (2013.01); *F24B 1/187* (2013.01); *F24B 1/19* (2013.01); *F24B 7/045* (2013.01)

(58) Field of Classification Search

CPC ..... F24B 1/028; F24B 1/1888; F24B 1/187; F24B 7/045; F23J 15/08; F23J 2215/00; F23J 2213/70; F23J 2219/80; F24D 15/02; F24D 19/1084; F23N 3/002; F23N 3/005; F23N 5/242; F23N 5/245

USPC ..... 126/66, 312, 77; 431/12

See application file for complete search history.

(56) References Cited

U.S. PATENT DOCUMENTS

| | | | | | |
|---|---|---|---|---|---|
| 2,866,602 | A | * | 12/1958 | Dailey, Jr. | F23D 14/60 431/62 |
| 3,288,199 | A | * | 11/1966 | Wladimir | F23N 5/003 236/15 E |
| 3,369,749 | A | * | 2/1968 | Siegmund | F23N 5/006 236/15 E |
| 4,113,417 | A | * | 9/1978 | Deruelle | F23G 5/46 431/12 |

(Continued)

FOREIGN PATENT DOCUMENTS

| | | | | |
|---|---|---|---|---|
| CA | 2789642 | A1 * | 3/2014 | F23N 3/002 |
| CA | 3111102 | A1 * | 9/2021 | F24B 1/1888 |

(Continued)

*Primary Examiner* — Steven B McAllister
*Assistant Examiner* — Daniel E. Namay
(74) *Attorney, Agent, or Firm* — Kinney & Lange, P.A.

(57) ABSTRACT

A control system for a fuel-burning appliance such as a wood or pellet burning stove may include a particulate matter sensor. The control system may also include an ignition system to ignite an ignition charge of ignitable fuel. A processor controls the operation of the functional components of the appliance to maintain operating conditions within pre-determined parameters.

7 Claims, 8 Drawing Sheets

(56) References Cited

U.S. PATENT DOCUMENTS 4,249,509 A * 2/1981 Syme ..... F24B 5/026 126/77
4,260,363 A * 4/1981 Cratin, Jr. ..... F23N 5/003 431/19
4,461,275 A * 7/1984 Lucas ..... F23N 3/047 126/72
4,568,266 A * 2/1986 Bonne ..... F23N 5/006 431/18
4,607,610 A * 8/1986 Zimmermann ..... F23L 3/00 126/76
5,566,667 A * 10/1996 Cox ..... F24C 15/20 126/307 R
7,838,297 B2 * 11/2010 Widmer ..... F23N 1/022 702/30
7,861,707 B2 * 1/2011 Wisener ..... F23B 1/38 236/11
8,011,359 B1 * 9/2011 Schultz ..... F24C 15/2042 126/550
8,627,775 B1 * 1/2014 Wilson ..... F24B 5/026 110/308
8,974,225 B2 * 3/2015 Malavasi ..... C10L 10/04 431/2
10,041,682 B1 * 8/2018 Myers ..... F23L 9/02
10,388,146 B2 * 8/2019 Piccolo, III ..... G08B 29/188
10,503,942 B1 * 12/2019 Thurston ..... G06F 11/3006
10,697,651 B2 * 6/2020 Nolan ..... F24B 1/19
2001/0003216 A1 * 6/2001 Komulainen ..... A62C 37/46 4/524
2002/0182552 A1 * 12/2002 Nielsen ..... F23J 11/04 431/77
2006/0049268 A1 * 3/2006 Weimer ..... F23N 3/082 236/51
2007/0186920 A1 * 8/2007 Wisener ..... F24B 1/024 126/73
2011/0012040 A1 * 1/2011 Bailey ..... F23N 5/003 73/23.31
2011/0300494 A1 * 12/2011 Masen ..... F23N 3/042 110/190
2014/0260511 A1 * 9/2014 Nemer ..... F23N 5/006 73/1.06
2014/0315137 A1 * 10/2014 Pedersen ..... F23L 9/04 431/12
2017/0051915 A1 * 2/2017 Cho ..... F23G 7/07
2017/0146239 A1 * 5/2017 Masen ..... F23N 5/102
2017/0184315 A1 * 6/2017 Nolan ..... F24B 13/04
2018/0180280 A1 * 6/2018 Neuschaefer ..... F23N 5/242
2019/0203936 A1 * 7/2019 Hazzard ..... F23N 5/006
2019/0351267 A1 * 11/2019 Gantos ..... F23J 99/00
2020/0236861 A1 * 7/2020 Sepulveda ..... F23N 5/003
2020/0355596 A1 * 11/2020 Cai ..... G01N 1/2273
2021/0095847 A1 * 4/2021 Shuk ..... F23N 5/003
2021/0239317 A1 * 8/2021 Deller ..... F23D 14/145

FOREIGN PATENT DOCUMENTS

CZ 17256 U1 * 12/2006 ..... F23N 5/18
JP 09303768 A * 11/1997 ..... F23N 5/003

* cited by examiner

CONTROL SYSTEM FOR A FUEL BURNING APPLIANCE AND A METHOD OF OPERATING SUCH AN APPLIANCE

CROSS-REFERENCE TO RELATED APPLICATION(S)

This application claims the benefit of U.S. Provisional Application No. 62/986,233 filed on Mar. 6, 2020, entitled "PARTICULATE MATTER EMISSION SENSING, AUTOMATIC LIGHTING AND AUTOMATIC AIRFLOW CONTROLS FOR FUEL BURNING APPLIANCE", by P. Hodges, D. Fong, W. Seo and C. Chan, which is incorporated by reference in its entirety.

FIELD

This disclosure relates to the field of fuel burning appliances, and in particular to a control system for a fuel burning appliance and a method of operating such an appliance. In one embodiment the appliance is a wood or pellet burning stove.

BACKGROUND

Fuel burning appliances or stoves have been used for centuries for heating and cooking purposes. Present day, the operation of such appliances can at times be subject to regulations that dictate levels of visible particulate matter that are permissible within an exhaust stream, and the general quality of emissions that are produced. Consumers of such products have also become considerably more discriminating than in the past, and commonly demand high levels of efficiency, means for temperature control, built in fans, and other automated systems that increase efficiency and/or enhance a user's experience. The increasing cost of operating hydrocarbon heating systems that burn oil, kerosene, or gas, together with enhancements in features and systems associated with solid fuel burning appliances and advancements in aesthetic designs, has seen solid fuel burning stoves and appliances that rely on wood or pellets as a fuel source experience increased popularity. In many cases the traditional wood or pellet burning stove has been transformed into a primary heating system in a residential or commercial setting, to the point where consumers demand features that they have become accustomed to in the case of other heating sources, all the while with an increasing eye on the environmental impact of the appliance.

In many cases adapting automated systems, common to other forms of heating systems and appliances that use traditional hydrocarbons as a fuel source, to a wood or pellet burning appliance has proved challenging. The interior of the firebox or combustion chamber of a wood or pellet burning appliance is often considerably more inhospitable than fuel oil, natural gas, or propane burning appliances and can present significant hurdles. Similarly, operation of a wood or pellet burning appliance or stove in a manner that reduces particulate matter emissions has been problematic. Others have in the past utilized catalytic converters in the exhaust stream of the appliance in an attempt to "burn" particulate matter that would otherwise be exhausted to the environment. While such catalytic converters have met with a degree of success, they generally operate without control and can result in excessive heating of both the room within which the appliance is situated and portions of the appliance itself. Catalytic converters can also be prone to clogging, in which case the movement of exhaust gases can be restricted, causing additional issues and concerns. Catalytic converters also commonly have a reduced effect at start-up, an operating condition that often results in significant particulate production. There is thus the need for continued advancement in emission control and the automation of the overall control and operation of solid fuel burning appliances and stoves as their use becomes more widespread.

SUMMARY

The present disclosure, in various aspects, provides particulate matter emission sensing, automatic ignition and automatic airflow controls for a fuel burning appliance such as a wood or pellet stove.

A particulate matter emission monitoring assembly is disclosed comprising generally a monitoring module that serves the function of determining the level of particulate matter within the exhaust stream of the stove. In an embodiment the module may be comprised of a particulate matter sensor, an enclosure, a venturi generating device, a vacuum pump, a gas intake probe, and a diluted gas probe. In operation, the vacuum pump is activated to extract gas from the firebox or combustion chamber through the gas intake probe. The exhaust gas is drawn through the venturi generating device, which has the effect of drawing in and diluting the exhaust gas with fresh air from an environment exterior to the firebox or combustion chamber. The diluted gas is directed through the diluted exhaust gas probe into the enclosure within which is positioned the particulate matter sensor. As the diluted exhaust gas passes by the sensor, the sensor transmits a signal to a central processor, which may comprise the main logic board or control of the stove. Depending upon the readings received from particulate the matter sensor, the central processor may control either the stove's primary, secondary and/or pilot air intake, either individually or in combination, to lower the particulate matter emission rate.

Also provided is an automatic ignition system for igniting wood or pellets in a wood or pellet burning stove or other fuel-burning appliance. The automatic ignition system is comprised generally of a combustion tray positioned beneath the bottom of the firebox or combustion chamber and below the primary fuel charge. The combustion tray is loaded with kindling (i.e. an ignition charge) and an electric heating element provides a heat source that can heat the kindling to its combustion point. A blower may be utilized to direct room or combustion air to the vicinity of the electric heating element. When the automatic ignition system is enabled, electricity is directed to the heating element causing the element to heat up and to raise the temperature of kindling to its point of ignition. With the combustion tray positioned beneath the bottom of the firebox, and immediately beneath a pre-loaded charge of firewood or pellets, the flame created from the burning kindling will ignite the firewood or pellets within the firebox.

There is further provided an automatic airflow control system that helps to control the burn characteristics of a wood or pellet burning stove and the ambient room temperature. The airflow control system is comprised generally of a temperature sensor or probe that is located at or near the exhaust exit of the firebox. The system further includes a temperature probe or sensor that is positioned to measure the ambient temperature of the room within which the stove is situated. The system further includes airflow valves, dampers and/or slide gates to control intake air passageways in a primary combustion air intake, a secondary combustion air intake, and/or a pilot air intake. The temperature sensors, combustion air blower, and airflow valves are preferably connected to a central processor such that the processor is capable of receiving input signals from the sensors and controlling the blower and the airflow valves.

Also disclosed is a wood or pellet burning stove or appliance incorporating the particulate matter emission monitoring assembly, automatic ignition system, and automatic airflow control system described above, wherein such assemblies and systems are controlled by a central processor that is controlled through a mobile app interface on a smart phone or a tablet, or through a hardware user interface.

An embodiment concerns a control system for a fuel-burning appliance, the control system comprising a particulate matter sensor, a gas intake configured to deliver gas from a combustion chamber or an exhaust duct of the appliance to the particulate matter sensor, a vacuum pump operatively associated with the gas intake, the vacuum pump configured to draw gas from the combustion chamber or the exhaust duct, through the gas intake, and to deliver said gas to the particulate matter sensor, a combustion air intake through which ambient air flows into the combustion chamber, a combustion air intake control configured to control the passage of ambient air through the combustion air intake and into the combustion chamber, and a processor operatively connected to the particulate matter sensor, the vacuum pump, and the combustion air intake control, wherein the processor is configured to operate the combustion air intake control to permit an increased or a decreased flow of ambient air through the combustion air intake in response to signals received from the particulate matter sensor corresponding to a level of particulate matter sensed in the gas delivered to the particulate matter sensor.

In another embodiment there is provided a method of controlling a fuel-burning appliance having a combustion chamber and an exhaust duct, the method comprising drawing gas from the combustion chamber or the exhaust duct and delivering the gas into a particulate matter sensor, with the particulate matter sensor, sensing a level of particulate matter in the gas and then generating and transmitting a signal, related to the level of sensed particulate matter, to a processor, with the processor, controlling a combustion air intake control to vary the volume of ambient air passing into the combustion chamber in response to the sensed level of particulate matter.

Also provided is an ignition system for a wood or pellet burning appliance having a combustion chamber for the burning of firewood or pellets, the ignition system comprising a combustion tray positioned within or immediately below the combustion chamber and configured to receive and retain an ignition charge of ignitable fuel, an electric heating element positioned in the combustion tray and in contact with the ignition charge when the ignition charge is present in the combustion tray, an ignition air blower configured to direct ambient or combustion air into the combustion tray, and a processor operatively connected to the electric heating element and the ignition air blower, the processor configured to energize the electric element and the ignition air blower upon the receipt of a command, and to thereby cause an ignition of the ignitable fuel.

There is further provided a method of operating a wood or pellet burning appliance, the method comprising loading an ignition charge of an ignitable fuel into a combustion tray positioned within the appliance and beneath a primary charge of firewood or pellets, upon the receipt of a command, causing a central processor to energize an electric heating element positioned in the combustion tray and in contact with the ignition charge, and causing the processor to operate an ignition air blower to direct ambient or combustion air into the combustion tray causing the ignition charge to be ignited.

Still further, the disclosure concerns a control system for a fuel burning heating appliance, the control system comprising an appliance temperature sensor located at or near an exhaust duct of the appliance; an ambient temperature sensor positioned in a room housing the appliance; a combustion air intake through which ambient air can flow into a combustion chamber of the appliance, the combustion air intake having associated with it a combustion air intake control configured to control the passage of ambient air through the combustion air intake and into the combustion chamber; and a processor operatively connected to the temperature sensor, the ambient temperature sensor, and the combustion air intake control, the processor configured to operate the combustion air intake control to permit ambient air to flow into the combustion chamber at a rate to sustain a burning fire within the combustion chamber that generates heat such that temperatures sensed by the appliance temperature sensor and the ambient temperature sensor are each within a predetermined range.

BRIEF DESCRIPTION OF THE DRAWINGS

For a better understanding of the present disclosure, and to show more clearly how it may be carried into effect, reference will now be made, by way of example, to the accompanying drawings which show exemplary embodiments of the present disclosure in which.

DESCRIPTION

The present disclosure may be embodied in a number of different forms. The specification and drawings that follow describe and disclose some of the specific forms of the disclosure.

Figure 1:
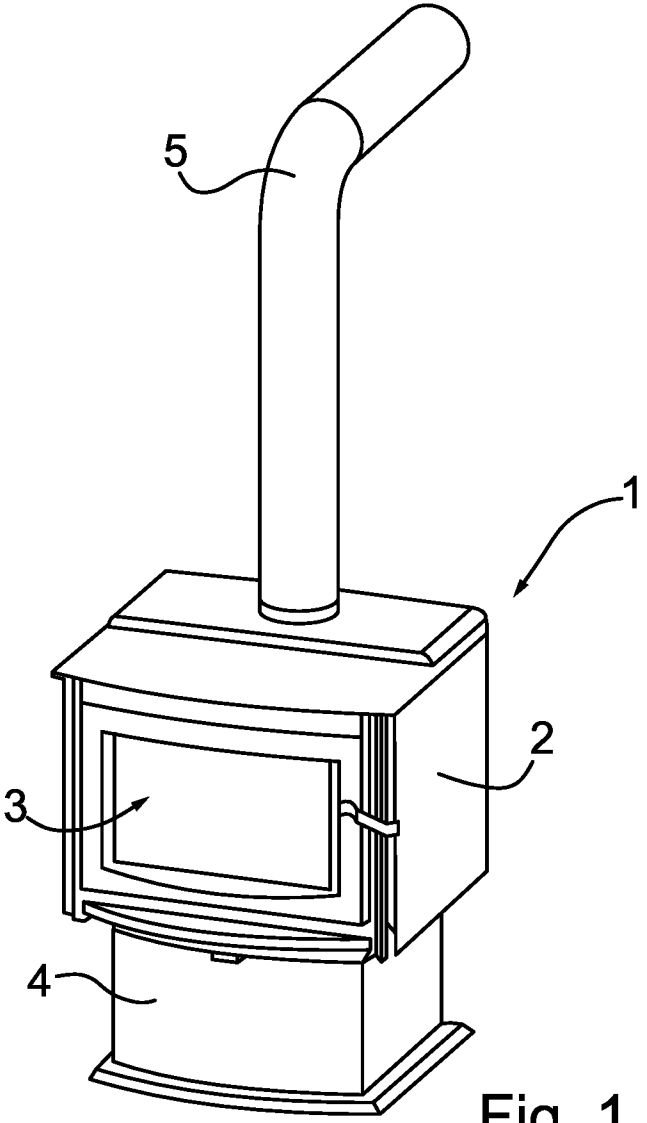
FIG. 1 is a front perspective view of a wood or pellet burning stove employing an embodiment of the present disclosure.
Figure 2:
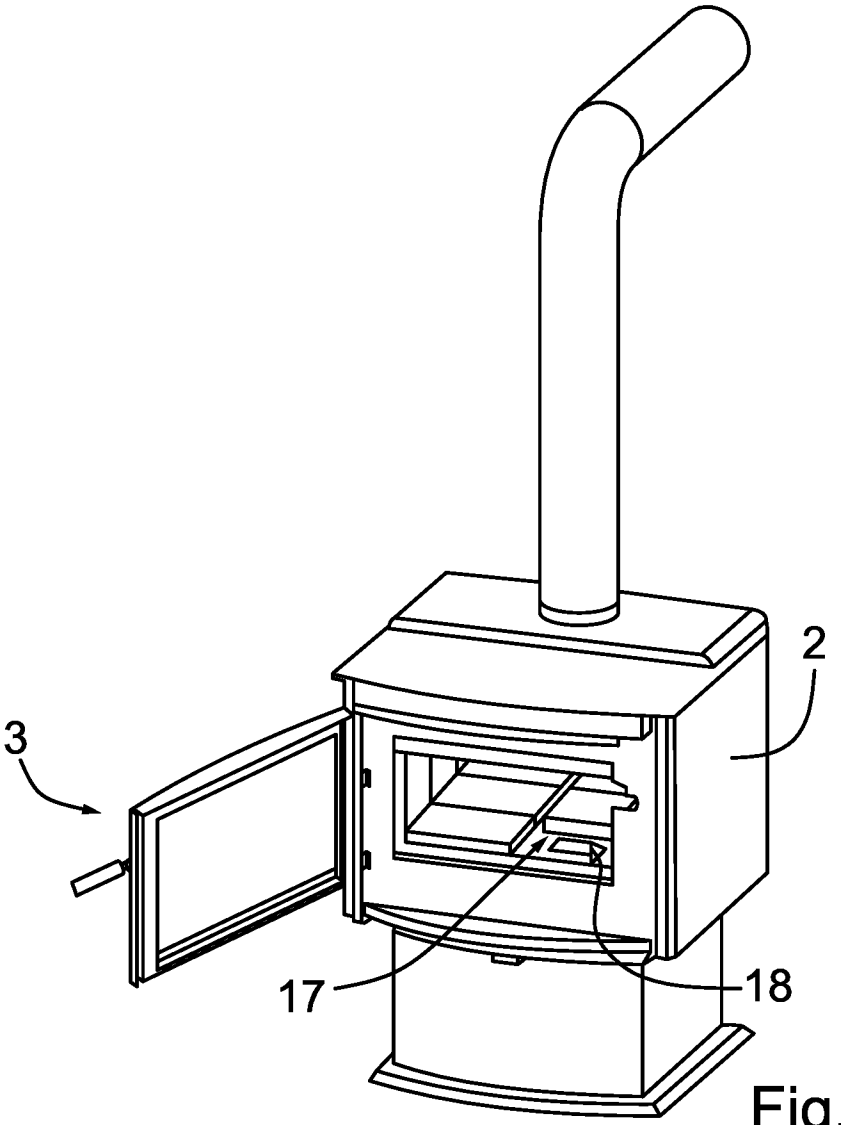
FIG. 2 is a view similar to FIG. 1 wherein the front door of the stove is in an open position.
Figure 3:
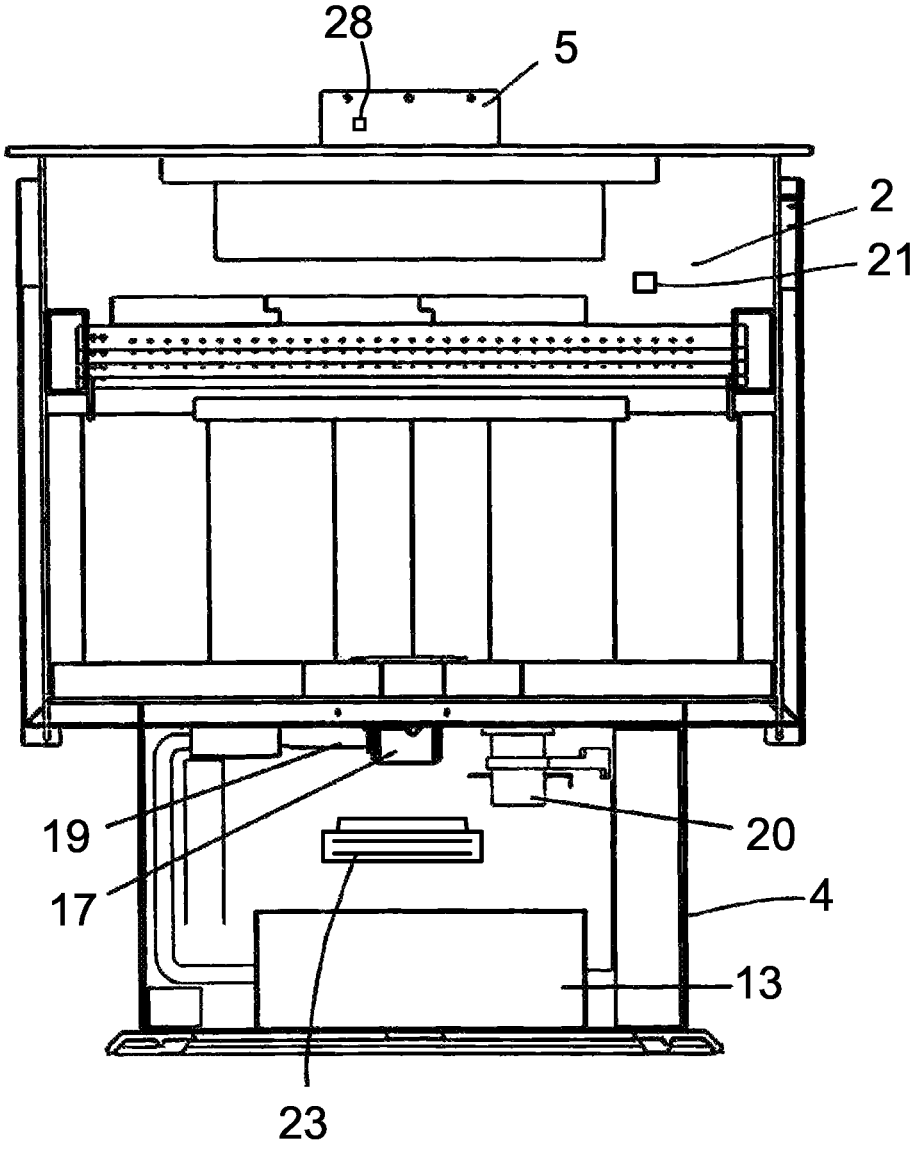
FIG. 3 is a front vertical sectional view of the stove of FIG. 1 showing a number of its internal components.
Figure 4:
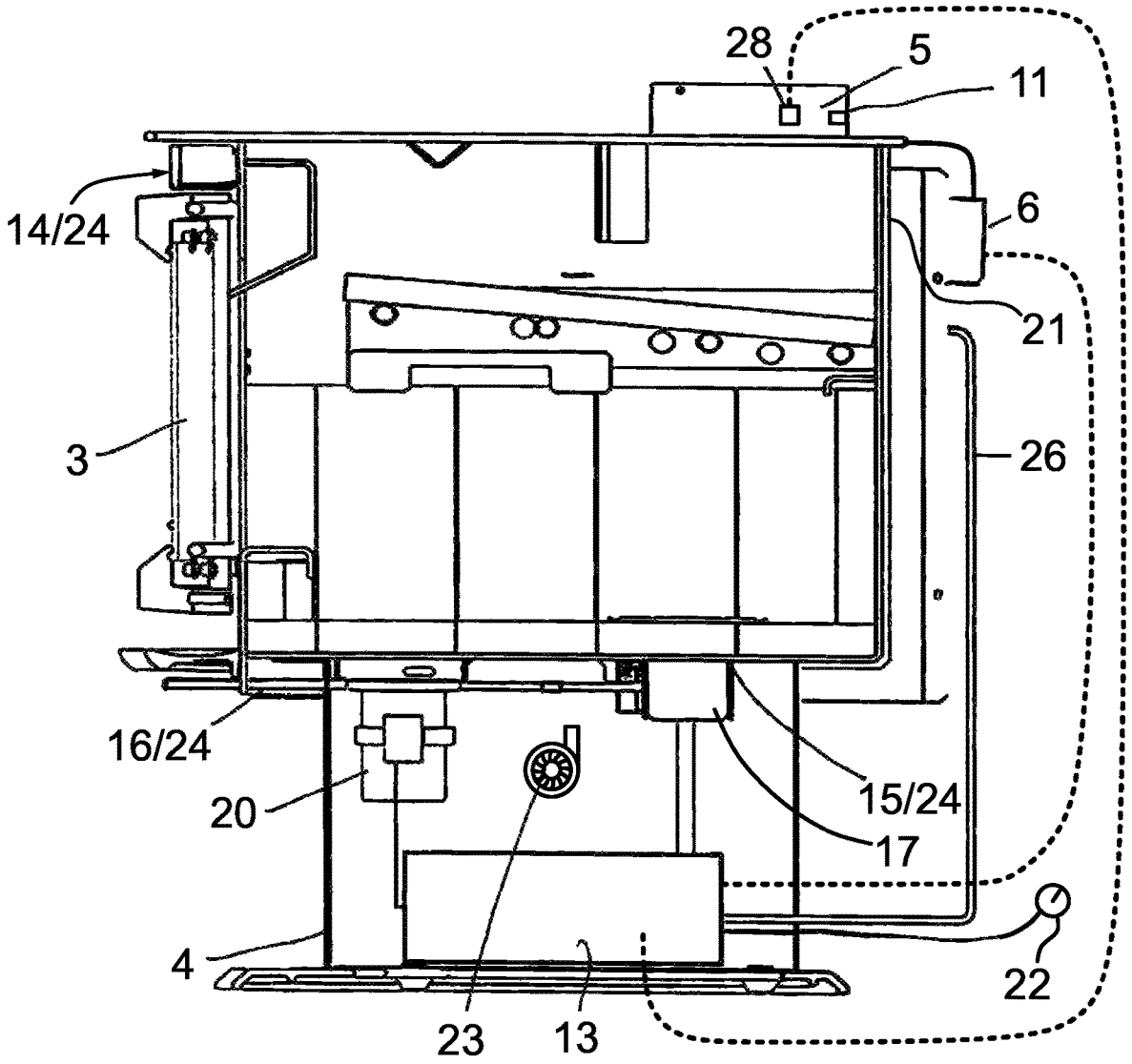
FIG. 4 is a side vertical sectional view of the stove of FIG. 1 showing a number of its internal components.
Figure 5:
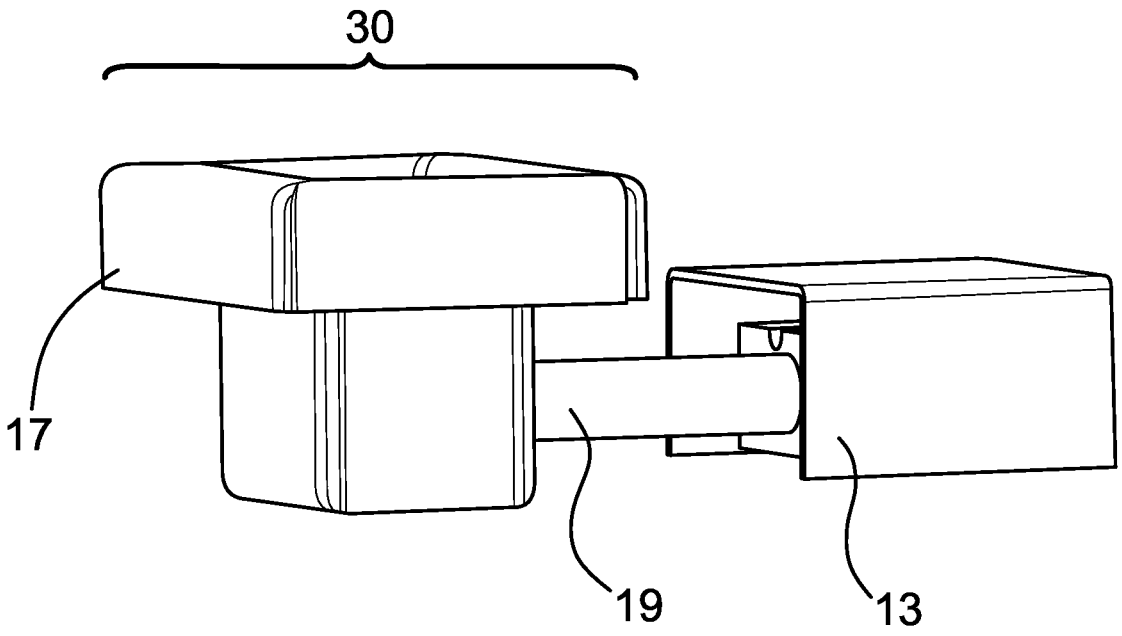
FIG. 5 is a side perspective schematic view of an automatic lighting or ignition system in accordance with an embodiment of the disclosure.
Figure 6:
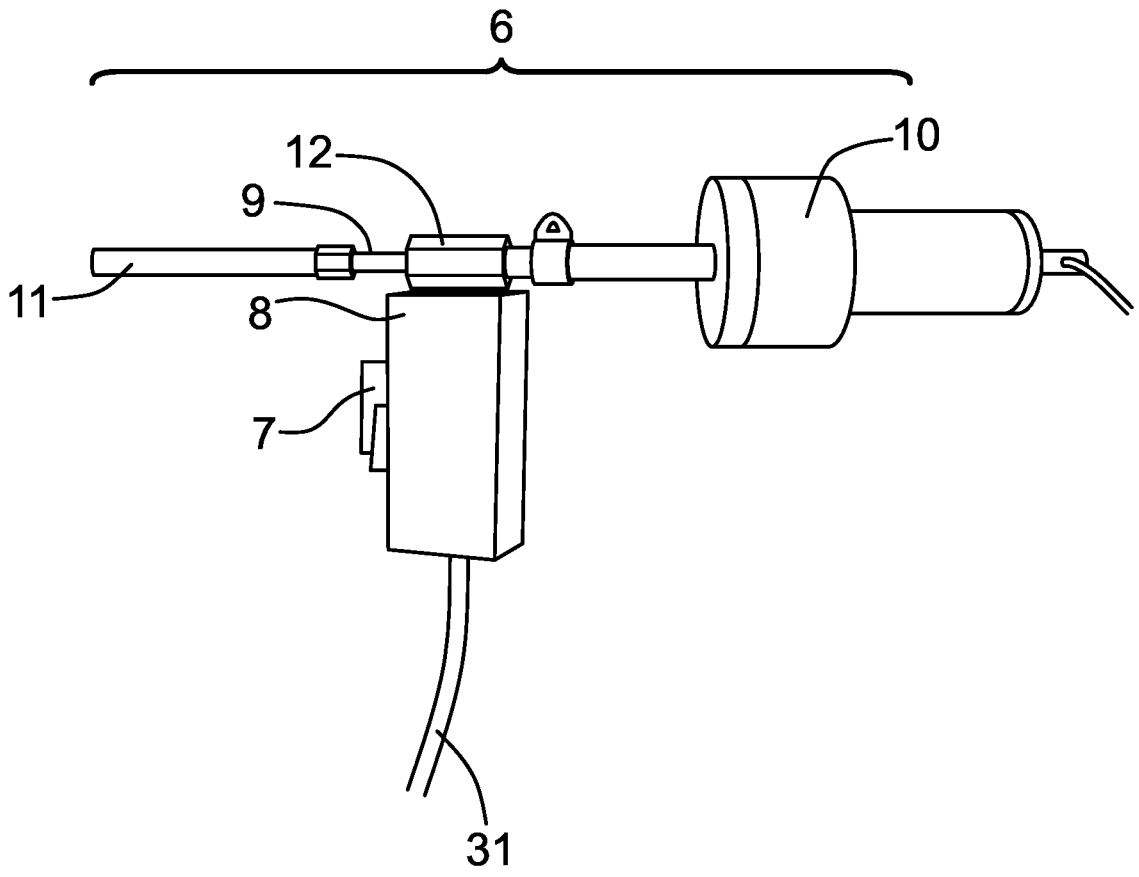
FIG. 6 is a view showing components of the particulate matter emissions sensing system in accordance with an embodiment of the disclosure.
Figure 7:
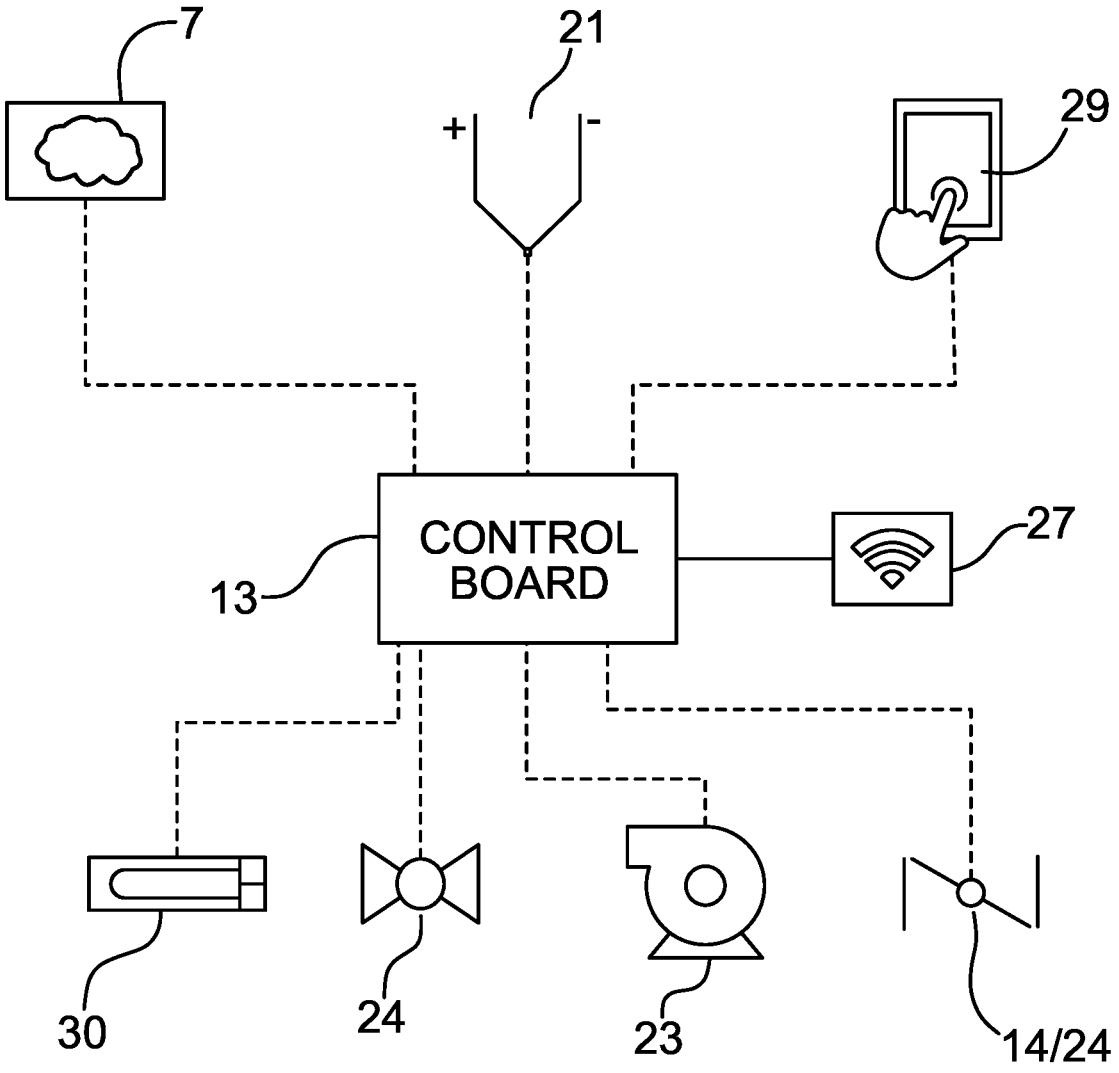
FIG. 7 is a schematic drawing demonstrating the operational control of the components of a wood or pellet burning stove in accordance with an embodiment of the disclosure.
Figure 8:
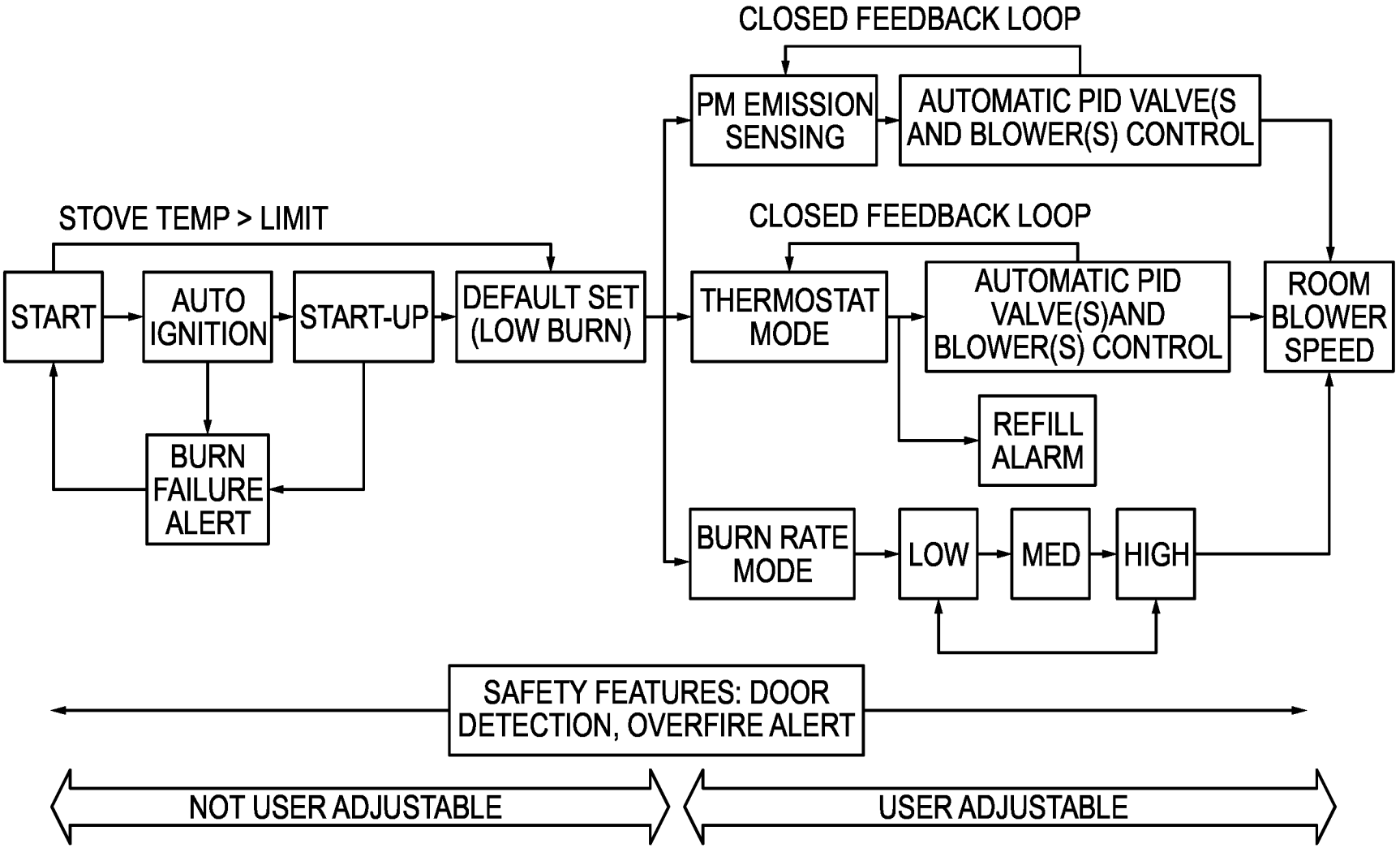
FIG. 8 is a control algorithm schematic of a wood or pellet burning stove in accordance with an embodiment of the disclosure.
Figure 9:
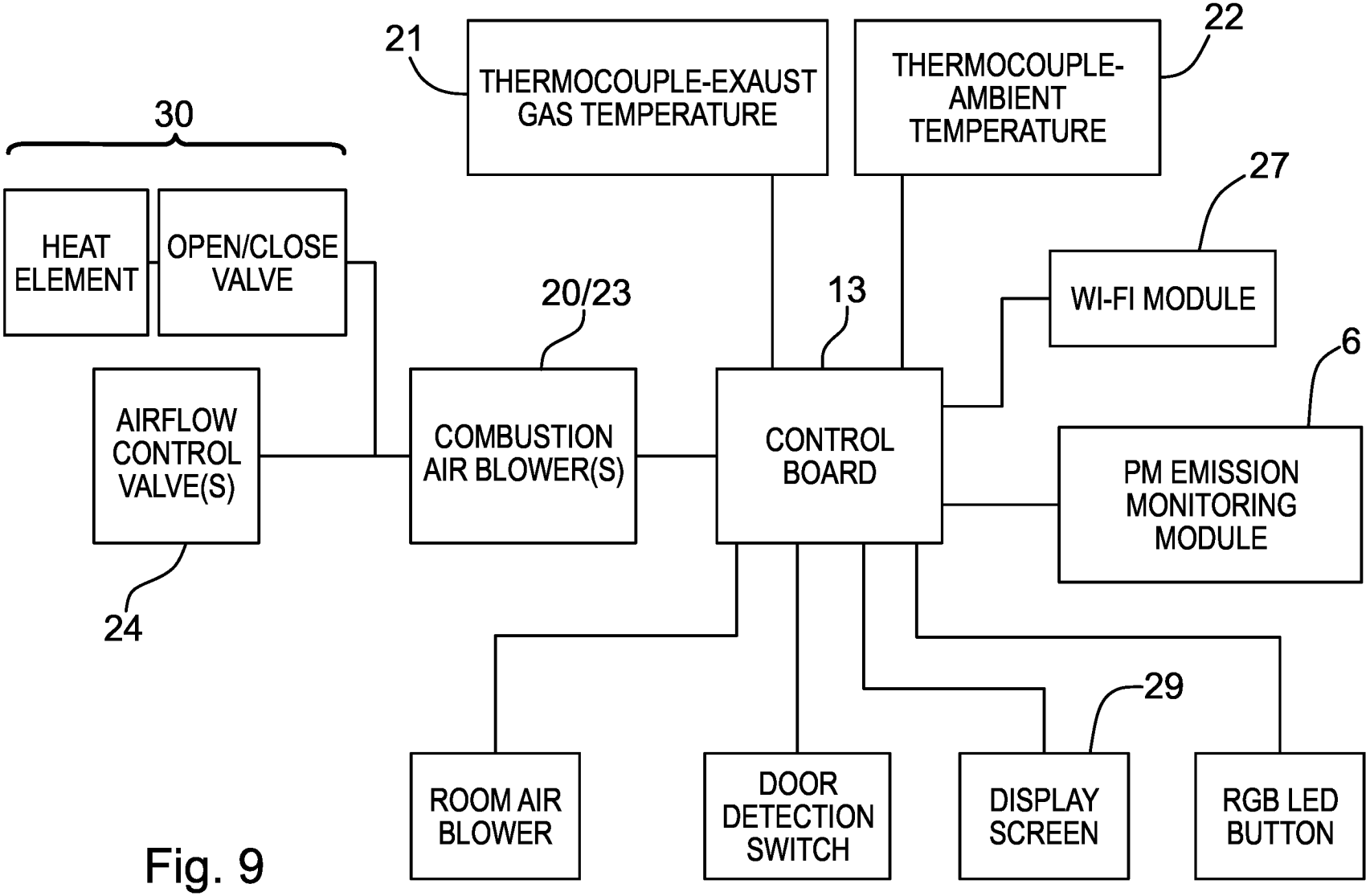
FIG. 9 is a control system algorithm schematic of a wood or pellet burning stove in accordance with an embodiment of the disclosure.

An exemplary fuel burning appliance outfitted with components in accordance with the present disclosure is shown in FIGS. 1 and 2. In this instance, the fuel burning appliance is represented as a wood or pellet burning stove 1. It will be appreciated that other forms of appliances, including a fireplace, fireplace insert, or heater, could equally be utilized. In the embodiment shown, stove 1 is comprised generally of a firebox or combustion chamber 2 having a front mounted door 3 and positioned on a pedestal 4, with a chimney 5 extending from the upper surface of the firebox. The overall structure and function of stove 1 is largely similar to many currently existing stoves or appliances.

In accordance with an aspect of the disclosure there is provided a control system for stove 1 that includes a particulate matter emission monitoring assembly. The particulate matter emission monitoring assembly is itself comprised generally of a monitoring module 6 that serves the function of determining the level of particulate matter within the exhaust stream of the stove. In an embodiment, module 6 is comprised of a particulate matter sensor 7, an enclosure 8, a venturi generating device 9, a vacuum pump 10, a gas intake probe 11, and a diluted gas probe 12. In operation, vacuum pump 10 is activated to extract gas from stove 1 through gas intake probe 11. The gas may be extracted from a variety of locations within the firebox or combustion chamber, however, it is expected that in most instances the gas will be extracted from a positon near the top of the firebox or, alternately, from within a position within chimney 5. The gas may be drawn through venturi generating device 9, which has the effect of also drawing in fresh air from an environment exterior to the firebox. The gas from the combustion chamber and the fresh air that is drawn in are directed through and mixed in diluted gas probe 12, following which they pass into enclosure 9, within which is positioned particulate matter sensor 7. As the diluted exhaust gas passes by sensor 7, the sensor transmits a signal to a central processor 13, which may comprise the main logic board or control of stove 1. Depending upon the readings received from particulate matter sensor 7, central processor 13 will control either the stove's primary, secondary, and/or pilot air intakes, individually or in combination, to lower the particulate matter emission rate, as described in more detail below. Gas that has passed by sensor 7 within enclosure 9 will typically be cycled back into stove 1 or chimney 5 through a return line 31.

Wood or pellet burning stoves are typically fitted with one or more combustion air intakes in order for room air to be drawn into firebox 2 for purposes of combustion. The most common forms of air intakes comprise a primary combustion air intake 14, a secondary combustion air intake 15, and a pilot air intake 16. It will be appreciated that not all wood or pellet burning stoves contain all three of these forms of air intakes and that some stoves may have one or more of these three most common forms. For illustration purposes, the stove shown in the attached drawings is indicated as including all three forms of intakes. Associated with each of the combustion air intakes there may also be a combustion air intake control or control mechanism (noted in the attached drawings generally by reference numeral 24) to control the flow of combustion air therethrough. Such control mechanisms may be in the form of airflow valves, dampers, or slide gates that may be opened or closed to varying degrees in order to control the intake of air into the firebox or combustion chamber. Each of these control mechanism may be controlled by central processor 13.

In the case of the operation of particulate matter monitoring module 6, as discussed above, particulate matter sensor 7 will generate a signal associated with the level of particulate matter within enclosure 8, with the signal being transmitted to central processor 13. Central processor 13 then determines the general level of particulate matter within the exhaust stream of stove 1, taking into account the level of dilution of the captured gas with room air. In most instances the particulate matter will be comprised of unburned hydrocarbons resulting from inefficient or incomplete combustion. Where the level of particulate matter within the exhaust stream exceeds a predetermined value, central processor 13 has the ability to control the intake of combustion air into firebox or combustion chamber 2. Central processor 13 will thus be operatively connected to the airflow valves, dampers, slide gates or other such control features on one or more of primary combustion air intake 14, secondary combustion air intake 15, and pilot air intake 16 to control the volume of room or ambient air drawn into the firebox. In some instances, stove 1 may be equipped with a combustion air blower 23 that, when activated, forces room or ambient air into the firebox. In those instances, central processor 13 may be operatively connected to blower 23 to operate the blower so as to increase or decrease the amount of combustion air within the firebox as required under the circumstances. Where an excessive amount of particulate matter is sensed within the exhaust stream, additional air drawn or forced into the firebox will tend to increase the rate of combustion and the degree or efficiency of the "burn" of the wood or pellet fuel source, helping to reduce the amount of particulate matter that reports to the exhaust stream. Combustion air blower 23 may be a variable speed blower.

As the level of particulate matter sensed by particulate matter sensor 7 decreases, central processor 13 can further control the amount of air that is permitted to be drawn into the firebox to establish a steady state combustion, wherein the level of particulate matter in the exhaust remains within defined limits. Further, stove temperature could be monitored with temperature sensors 21 placed on or about the stove or the firebox/combustion chamber and connected to central processor 13 by means of wires that may be protected with metal tube 26.

The gaseous environment within the firebox of a wood or pellet burning stove can have a relatively high water content during operation. It has been discovered by the inventors that a high level of moisture within the exhaust gas can result in inconsistent, and in some instances incorrect, particulate matter emission readings. The utilization of venturi generating device 9, and the dilution of the exhaust gas with room air, has been found to sufficiently counteract the effect of the moisture within the exhaust gas to ensure more accurate and more consistent particulate matter emission readings.

Although the particulate matter monitoring module could potentially be located at a variety of different locations on or about stove 1, it is expected that in most instances module 6 will be positioned at either the back or below the firebox/combustion chamber with gas collected or sampled from either a position toward the top of firebox/combustion chamber 2 or from within chimney 5. In stoves that are equipped with catalytic converters, the gas may be collected either upstream or downstream of the catalytic converter, with appropriate adjustments made to the software of central processor 13 to account for whether or not the exhaust gas has passed through a catalytic converter.

In accordance with an embodiment of the disclosure, there is also provided an automatic ignition system 30 for igniting firewood wood or pellets in a wood or pellet burning stove. The automatic ignition system is comprised generally of a recessed combustion tray 17 positioned in or immediately beneath the bottom of firebox or combustion chamber 2. Combustion tray 17 would typically be loaded with kindling or other such easily ignitable material (an ignition charge) 18, which could be comprised of pellets, a cardboard-type product, small pieces of wood, or other forms of fire starter. An electric heating element 19 is located adjacent to kindling or ignition charge 18 to provide a source that can heat the kindling to beyond its combustion point. Combustion air blower 23 may be utilized to direct room or combustion air to the combustion tray and in the vicinity of the electric heating element. Further an air valve 20 (primary air valve) may be used to control input air entering the firebox.

When the automatic ignition system is enabled, electricity is directed to heating element 19 causing the element to heat up and to raise the temperature of kindling contacting the element to its point of ignition. Air from blower 23 passes over the heating element to help ignite the kindling an to establish a sustained flame. Preferably, combustion tray 17 will be positioned beneath the bottom of the firebox and immediately beneath a pre-loaded primary charge of firewood or pellets, such that the flame created from the burning kindling will ignite the firewood or pellets within the firebox.

It is expected that in most embodiments the operation of electric heating element 19 and blower 23 will be controlled by central processor 13. It is also expected that one or more temperature sensors 21 will be placed on or about firebox/combustion chamber 2 and connected to central processor 13 such that the central processor can generally become aware of when the primary charge of firewood or pellets within the stove has been ignited by the burning kindling, through a sensed increase in firebox temperature. In alternate embodiments, both a temperature sensor and/or an optical sensor could be utilized to indicate the ignition of the primary charge of firewood or pellets. Once central processor 13 senses the ignition of the main or primary charge in the firebox, heating element 19 can be de-energized. It may also be desirable to place a time limit on the energization of heating element 19 such that it is automatically de-energized after a defined time regardless of whether combustion in the firebox is sensed. The energization of heating element 19 can be controlled by a remote hard wired user interface or though a smart phone or computer app that is used to operated central processor 13. In an embodiment, the energization of heating element 19 and the ignition of a main or primary fuel charge in the firebox could also be controlled by a room temperature senor 22 that causes the stove to "start-up" should room temperature drop below a predetermined level.

Further, the degree of particulate matter within the exhaust of the stove when ignition is initially commencing can be monitored and controlled by particulate matter monitoring module 6. That is, an excessive amount of particulate matter that is sensed within the stove's exhaust stream during start up could indicate an inefficient combustion situation where the stove may be starved of air. Under that scenario central processor 13 can operate the control mechanisms on one or more of the primary, secondary and/or pilot combustion air intakes to allow additional combustion air to be drawn into the firebox, and to thereby promote a more efficient burning environment, a more efficient and complete ignition of the charge of firewood or pellets within the firebox, and a reduction in particulate matter emissions. The control of the stove's or appliance's air intake can occur contemporaneously with the monitoring of the temperature sensor(s) and particulate matter module 6 during start up to help minimize particulate matter generation. During start up, until the stove senses that the primary fuel charge has been ignited (for example, until temperature sensors 21 record a temperature of a pre-determined level) it is expected that combustion will be less than optimum and that excessive particulate matter may be created. Control of the operation of the automatic ignition and combustion air systems will at times require central processor 13 to balance the generation of higher than normal levels of particulate matter against the need to establish an ignition of the main charge of fuel in the store, while appreciating that higher levels of particulate matter are likely to report to exhaust streams during times of start up. At this time the central processor may be in what may be referred to as a "start-up" mode. Once the temperature sensors indicate that the primary fuel charge has been ignited (or in an alternate embodiment after a pre-determined time), central processor 13 can switch to an operational mode where intake air can be more closely controlled to minimize particulate matter generation without the threat of snuffing out the flame.

As discussed above, in an embodiment of the disclosure there is also provided an automatic airflow control system that helps to control the burn characteristics of stove 1 and the ambient room temperature. The airflow control system is comprised generally of one or more appliance temperature sensors or probes 21 that may be located at or near the exhaust duct of the combustion chamber. The system further includes one or more ambient temperature sensors or probes 22 that are positioned to measure the ambient temperature of the room within which stove 1 is situated. The system may further include combustion air intake controls or control mechanisms to control openings or passageways in combustion air intakes (which may include primary, secondary and pilot air intakes 14, 15 and 16) that supply combustion air to the firebox, as well as combustion air blower 23. As mentioned above, the means to control intake air passageways in primary combustion air intake 14, secondary combustion air intake 15, and pilot air intake 16 could be any one of a variety of different mechanisms commonly used to control the passage of air or a gas through a conduit, including airflow valves, dampers and slide gates. In the particular embodiment shown, such means are comprised of airflow valves 24. Temperature sensors 21 and 22, combustion air blower 23, air valve 20, and airflow valves 24 are preferably connected to central processor 13 such that the processor is capable of receiving input signals from the sensors and controlling the blower and airflow valve(s).

During operation of stove 1, the ambient temperature of the room within which the stove is situated can be monitored and compared by central processor 13 to a predetermined temperature, that may be adjusted by way of a thermostat or other means. Where it is determined that the room temperature is below a predetermined value, central processor 13 can operate air valves 24 and/or blower 23 to permit additional combustion air to be drawn or forced into the firebox, and to thereby enhance the burn and increase the heat output of the stove. In one embodiment, central processor 13 can be programmed such that where, after a predetermined time frame following the "opening" of combustion air intakes, should the ambient room temperature not be increased to the desired temperature blower 23 may be activated to further enhance burn characteristics within the firebox. Central processor 13 may also be programmed to activate blower 23 in situations where the differential between the room air temperature and the predetermined desired temperature exceeds a predetermine value, such that additional combustion air is added to the firebox as a means to increase the burn and to thereby cause the stove to raise the temperature of the room more quickly. Alternately, central processor 13 may be programmed to operate blower 23 at a point where airflow valves 24 are opened to a predetermined degree. Controlling the operation and speed of blower 23 in conjunction with the operation of airflow valves 24 may help to prevent excessive noise generation should the blower(s) be operated when the valves are only slightly open.

Control processor 13 may be further programmed to operate stove 1 in a manner that is consistent with a user specified burn characteristic. For example, where door 3 includes a viewing port or viewing window, in some instances it may be desirable for aesthetic reasons to cause the stove to produce a relatively substantial flame, even where the production of heat to increase ambient temperature may not necessarily be required. In such an instance, control processor 13 can operate the stove such that airflow valves 24 and/or blower 23 are operated in a manner that creates a visually pleasing fire, largely irrespective of the ambient room temperature.

Further, control processor 13 can be programmed to control the burn characteristics of stove 1 through reference to particulate matter monitoring module 6. That is, and mentioned previously, where an excessive amount of particulate matter in the exhaust stream is sensed, central processor 13 can operate airflow valves 24 and/or blower 23 in a manner that enhances the burn within the firebox in an attempt to cause more complete combustion and a reduction in the particulate matter reporting to the exhaust stream.

The operation of control processor 13, in conjunction with the additional components described above, has the net effect of allowing a user to control room temperature, burn characteristics, and the cleanliness of the burn, subject to maximum limits that may be imposed by environmental protection agencies or other jurisdictions. Control processor 13 can be programmed to monitor readings from temperature sensor(s) 21 in order to detect a potential "over firing" situation where the fire within firebox or combustion chamber 2 reaches a dangerous state and wherein safe operating temperatures have been exceeded. In such instances, central processor 13 can operate to adjust airflow valves 24 and/or blower 23 in a manner that reduces air delivered to the combustion chamber to reduce the level of the burn within the firebox and to ensure consumer safety. Later, where the potential of "over firing" has been eliminated, central processor 13 may re-engage airflow valves 24 and/or blower 23 to the extent necessary to maintain the burn characteristics and operational profile for the stove as previously defined, or as input by a user. A sensor 28 may also be placed within chimney to help detect a potential chimney fire. In the case of excessive temperatures detected in the chimney, which could be indicative of a chimney fire, central controller 2 would operate to close off air entering the firebox in an attempt to lower the exhaust gas temperature to a safe level.

In accordance with an embodiment of the disclosure, the above mentioned functions of stove 1 may be controlled through a mobile app interface on a smart phone or a tablet, or through a local or remote hardware user interface. In such cases central processor 13 will typically be fitted with a Wi-Fi or similar module 27. In the case of a hardware user interface, a control panel may be provided that includes switches, buttons, dials, etc. that can be operated by a user to control burn characteristics and to establish pre-set temperatures for the operation of stove 1. There may also be provided a digital or analog display 29 to visually indicate burn characteristic details to the user. Display 29 may be a touch screen display to all then enter of operational parameters. In some instances some of the components of the various control systems may be millivolt controls, where the stove itself produces power necessary to operate the controls so that components remain operational during electrical power failures. In other instances, one or more of the control systems may be battery powered or directly wired to the electrical system of the room within which the stove is situated. Where the functions of stove 1 are controlled through a mobile app, the app will typically provide a dashboard on a smart phone, tablet or computer that will indicate the operating parameters and burn characteristics of the stove, and will provide a user interface for a user to alter those characteristics and alter the operation and functionality of the stove. The control of central processor 13 may also be established through use of a wired or wireless hand held remote control.

It will thus be appreciated that the above described structure permits, in one embodiment, the automated operation of a wood or pellet burning stove or appliance. The control and functionality of the stove can be accomplished through activation of a touchscreen, a keypad, a remote control, and/or a remote smart phone or computer. The ignition of a charge of fuel in the stove can be controlled, as can the burning characteristics of the stove, including characteristics that are purely for aesthetic purposes. Further, the stove can be automatically operated in a manner that helps to minimize particulate emissions and that maximizes efficiency. The functionality of the components of the stove permit remote operation over a wireless or wired network. Further, inherent safety features may be incorporated into the operational logic to aid in the safety of structures and personnel. In that regard, excessive temperature readings can result in an automatic reduction in combustion air intake into the firebox to reduce combustion rates. Alternately, combustion air could be essentially cut off completely from the firebox under certain circumstances.

It is to be understood that what has been described are the preferred embodiments of the disclosure. The scope of the claims should not be limited by the preferred embodiments set forth above, but should be given the broadest interpretation consistent with the description as a whole.

What is claimed is:

1. A control system for a fuel-burning appliance, the control system comprising:

a particulate matter sensor, a gas intake configured to deliver gas from a combustion chamber or an exhaust duct of the appliance to the particulate matter sensor, a vacuum pump operatively associated with the gas intake, the vacuum pump configured to draw gas from the combustion chamber or the exhaust duct, through the gas intake, and to deliver said gas to the particulate matter sensor, a combustion air intake through which ambient air flows into the combustion chamber, a combustion air intake control configured to control the passage of ambient air through the combustion air intake and into the combustion chamber, a processor operatively connected to the particulate matter sensor, the vacuum pump, and the combustion air intake control, wherein the processor is configured to operate the combustion air intake control to permit an increased or a decreased flow of ambient air through the combustion air intake in response to signals received from the particulate matter sensor corresponding to a level of particulate matter sensed in the gas delivered to the particulate matter sensor, and a venturi generator and a diluted gas probe, wherein the vacuum pump is configured to draw gas from the combustion chamber or the exhaust duct through the venturi generator, the venturi generator is configured to draw ambient air for mixing with the gas from the combustion chamber or the exhaust duct in the diluted gas probe, and the diluted gas probe is configured to deliver the mixed gas and air to the particulate matter sensor.

2. The control system as claimed in claim 1 comprising a combustion air blower that operates to deliver ambient air into the combustion chamber, the combustion air blower being operatively connected to the processor, and the processor being configured to control operation of the combustion air blower and thereby control a volume of ambient air delivered to the combustion chamber by the combustion air blower.

3. The control system as claimed in claim 2 comprising a temperature sensor operatively associated with the combustion chamber or the exhaust duct, the temperature sensor being configured to generate a signal corresponding to a sensed temperature in the combustion chamber or the exhaust duct and to transmit the signal to the processor, and the processor being configured to operate the combustion air intake control and combustion air blower to reduce the volume of ambient air delivered to the combustion chamber when the sensed temperature exceeds a predetermined value.

4. The control system as claimed in claim 1 comprising an exhaust duct sensor operatively connected to the processor, the exhaust duct sensor being configured to communicate with the processor upon sensing a condition of a fire in the exhaust duct, and the processor being configured to operate the combustion air intake control so as to limit the flow of ambient air into the combustion chamber upon the sensor sensing a condition of fire.

5. A method of controlling a fuel-burning appliance having a combustion chamber and an exhaust duct, the method comprising:

drawing gas from the combustion chamber or the exhaust duct and delivering the gas into a particulate matter sensor, with the particulate matter sensor, sensing a level of particulate matter in the gas and then generating and transmitting a signal, related to the level of sensed particulate matter, to a processor, with the processor, controlling a combustion air intake control to vary a volume of ambient air passing into the combustion chamber in response to the sensed level of particulate matter, and utilizing a vacuum pump to draw the gas from the combustion chamber or the exhaust duct into the particulate matter sensor, comprising drawing the gas from the combustion chamber or the exhaust duct through a venturi generator, mixing the gas with ambient air in a dilution gas probe, and thereafter delivering the mixed gas and ambient air to the particulate matter sensor.

6. The method as claimed in claim 5 comprising operating the processor to control operation of a combustion air blower in response to the sensed level of particulate matter and/or temperature readings from a temperature sensor positioned in the combustion chamber or the exhaust duct.

7. The method as claimed in claim 6 comprising monitoring the temperature of the combustion chamber and/or the exhaust duct, and causing the processor to operate the combustion air intake control so as to reduce the volume of ambient air permitted to flow into the combustion chamber in response to temperatures of the combustion chamber or exhaust duct that exceed pre-determined values.

* * * * *